US006330949B1

(12) United States Patent
DeRisio

(10) Patent No.: US 6,330,949 B1
(45) Date of Patent: Dec. 18, 2001

(54) HANGER STORAGE SYSTEM

(76) Inventor: David T. DeRisio, 221 E. 44th, Boise, ID (US) 83714

( * ) Notice: Subject to any disclaimer, the term of this patent is extended or adjusted under 35 U.S.C. 154(b) by 0 days.

(21) Appl. No.: 09/277,479

(22) Filed: Mar. 26, 1999

Related U.S. Application Data

(60) Provisional application No. 60/079,687, filed on Mar. 26, 1998.

(51) Int. Cl.[7] ..... A47F 7/00

(52) U.S. Cl. ..... 211/85.7; 211/113; 211/117; 24/129 R; 24/129 B; 24/130; 24/115 H

(58) Field of Search ..... 211/85.7, 117, 211/113; 4/605; 24/115 H, 129 R, 130, 129 B

(56) References Cited

U.S. PATENT DOCUMENTS

| | | | | |
|---|---|---|---|---|
| Re. 12,147 | * | 8/1903 | Proddat | 125/1 |
| 285,159 | * | 9/1883 | Reynolds | 211/113 |
| 314,813 | * | 3/1885 | Ferris | 24/129 R |
| D. 382,793 | * | 8/1997 | Wilcox | D8/356 |
| 809,359 | | 1/1906 | Dial . | |
| 828,765 | * | 8/1906 | Nilsson | 24/130 |
| 837,247 | * | 11/1906 | Nuttall | 24/129 B |
| 890,898 | * | 6/1908 | Gaillac | 24/129 B |
| 928,469 | * | 7/1909 | Miles | 135/118 |
| 1,806,162 | * | 5/1931 | Hahn | 24/129 B |
| 1,929,843 | * | 10/1933 | Gaus | 24/28 |
| 2,018,395 | | 10/1935 | Bower | 204/5 |
| 2,229,935 | * | 1/1941 | Powers | 24/131 |
| 2,953,828 | | 9/1960 | Hochman | 24/17 |
| 3,524,443 | * | 8/1970 | Batlin | 128/76 |
| 3,675,276 | * | 7/1972 | Nuse | 24/130 |
| 3,709,373 | | 1/1973 | Aguilar | 211/113 |
| 3,736,925 | * | 6/1973 | Erman | 128/76 B |
| 3,749,348 | | 7/1973 | Bartlett | 248/359 |
| 3,953,911 | * | 5/1976 | Fishack | 24/16 R |
| 4,067,454 | * | 1/1978 | Helbling | 211/117 X |
| 4,125,257 | * | 11/1978 | Lew | 272/109 |
| 4,221,024 | * | 9/1980 | Becker | 24/115 H |
| 4,355,444 | * | 10/1982 | Haney | 24/129 B |
| 4,529,240 | * | 7/1985 | Engel | 294/141 |
| 4,654,991 | | 4/1987 | Jones | 40/617 |
| 4,749,088 | | 6/1988 | Workman et al. | 211/13 |
| 4,878,585 | | 11/1989 | Orestano | 211/87 |
| 4,939,820 | * | 7/1990 | Babcock | 24/129 R |
| 4,963,152 | * | 10/1990 | Hofmann et al. | 623/18 |
| 5,027,960 | | 7/1991 | Rainville | 211/118 |
| 5,137,158 | * | 8/1992 | Brockway | 211/87 |
| 5,141,113 | | 8/1992 | Elliot | 211/13 |
| 5,148,926 | | 9/1992 | Cocuzzo et al. | 211/118 |
| 5,240,059 | | 8/1993 | White | 160/349.2 |
| 5,282,825 | * | 2/1994 | Muck et al. | 606/203 |
| 5,350,071 | * | 9/1994 | Pond | 211/70.6 |
| 5,351,346 | * | 10/1994 | Hodges, Jr. | 211/113 |
| 5,368,268 | * | 11/1994 | Jodwischat | 248/309.4 |

(List continued on next page.)

*Primary Examiner*—Alvin Chin-Shue
*Assistant Examiner*—Khoa Tran
(74) *Attorney, Agent, or Firm*—Ken J. Pedersen; Barbara S. Pedersen

(57) ABSTRACT

Embodiments of a hanger system are shown and described, each embodiment including a support member and at least one looped cord hanging from the support member. The looped cord includes a cleat or other adjustable fastener for adjusting the diameter of the loop, so that is fits around and securely holds differing sizes of items in the loop, preferably, up off of the ground or floor. The cleat may have sharp exterior corners and notches for gripping an item being held, and sharp interior hole corners for gripping the cord. An attractive hanger may be constructed by using an elongated, straight, narrow bar of wood, plastic, or metal, that has holes bored through it to receive and capture knots in the ends of the cords. Thus, several cords may hang from the support member, spaced several inches or more from each other, so that the cords hang down without tangling and the suspended items do not significantly interfere with each other while hanging or while being hung or removed.

8 Claims, 3 Drawing Sheets

U.S. PATENT DOCUMENTS

| | | | | |
|---|---|---|---|---|
| 5,511,293 | | 4/1996 | Hubbard, Jr. et al. | 24/442 |
| 5,531,418 | * | 7/1996 | Lindgren | 248/317 |
| 5,548,873 | * | 8/1996 | Macias | 24/134 |
| 5,551,579 | | 9/1996 | Converse | 211/70.2 |
| 5,625,925 | * | 5/1997 | Richards | 24/129 B |
| 5,784,763 | * | 7/1998 | Cassidy | 24/130 |
| 5,799,601 | * | 9/1998 | Peay | 114/98 |
| 5,852,853 | * | 12/1998 | Pennoyer, Jr. | 24/134 P |
| 5,855,285 | * | 1/1999 | Laird et al. | 211/70.6 |
| 5,992,342 | * | 11/1999 | Nordin et al. | 114/343 |
| 6,003,210 | * | 12/1999 | Facey et al. | 24/130 |
| 6,029,870 | * | 2/2000 | Giacona, III | 224/148.6 |
| 6,036,066 | * | 3/2000 | Giacona, III | 224/148.6 |

* cited by examiner

HANGER STORAGE SYSTEM

This application is a conversion of, a continuation-in-part of, and claims priority from, prior pending provisional application Ser. No. 60/079,687 filed on Mar. 26, 1998 with the same title.

BACKGROUND OF THE INVENTION

1. Field of the Invention

This invention relates generally to the storage of consumer articles, and to storage systems for such articles. More specifically, this invention is a storage system comprising cords with securing cleats hanging from a supporting rack which is fastened to a wall.

2. Related Art

Several U.S. Patents disclose devices for hanging items from multiple cords. For example:

U.S. Pat. No. 2,018,395 (Bower, issued Oct. 22, 1935) discloses an electroplating rack having a cross member with a plurality of spaced portions provided with aligned apertures, and a retractable rod inserted through the apertures. Articles to be electroplated hang from cords tied around the retractable rod, and may be dropped from the device by retraction of the rod.

U.S. Pat. No. 2,953,828 (Hochman, issued Sep. 27, 1960) discloses a device for keeping socks in pairs during laundering comprising a cloth anchoring cross member with pairs of cloth tying members extending from the anchoring cross member.

U.S. Pat. No. 3,709,373 (Aguilar, issued January 1973) discloses a suspended elongated main cord having a plurality of flexible loops secured to the main cord at spaced apart points to secure and support articles along the main cord.

Still, there exists a need in the storage system art for a simple and inexpensive wall-mounted hanger system for securing and supporting consumer articles. There is a need for such a system that does not require cords to be tied around the consumer articles and that is not conducive to tangling and disarray. This invention addresses that need.

SUMMARY OF THE INVENTION

The present invention is a hanger storage system, comprising a support member having a horizontal dimension, and a plurality of horizontally spaced cords connected to the support member and hanging down from the support member. Some or all of the cords have loops on their distal ends, for receiving consumer articles such as sports gear, tools, household supplies, etc. Preferably, each loop is adjustable in size. The adjustable loop may be formed by a moveable cleat or other fastener that slidably connects the distal end of the cord to the middle section of the cord and that may be slid along the cord until leverage is placed on the cleat to pivot it relative to the cord and thereby "bite" or grip the cord to maintain the size of the loop. Preferably, the loop is tightened around the consumer article and the cleat is slid in to be close to the article (see FIG. 6), so that the cleat grips the cord and preferably also grips the article, for added security. The article is surrounded by the cord loop and is thereby suspended from the hanger.

The preferred cleat and cord system also is useful for hanging articles having straps, loops, or handles, such as backpacks, coats, or jugs, for example. This is performed by positioning the cleat and loop system into configurations that cooperate with the strap, loop, or handle (See FIGS. 9 and 10), that is the cord loop and/or cleat pass through the article strap, loop, or handle. For example, the loop may be threaded through a backpack strap and then the loop's end is hung over the cleat with the cleat positioned in a generally vertical position, thus capturing the backpack strap. Or, the loop may be threaded through a jug handle and then the end of the loop is hung over the jug neck itself, thus capturing the jug. Or, the cleat may hang from the cord and, because of the angle of the cleat to the cord, the cleat acts as a "hook" for receiving/passing through a coat loop.

Each cord of the invented hanger may be used to suspend a different article, so that several, differently-sized and differently-shaped articles hang generally side-by-side and are separated by several inches of space. The hanging articles are, therefore, neatly arranged and restrained from falling over or being jumbled in a pile, as is the case in so many workshops, garages, basements, and closets.

When the user wishes to remove an article from the invented hanger, he/she may do so easily and without removing the other items or dealing with falling items. In the many cases in which the article has been slid into the loop and the loop and cleat have been tightened against the article, the user may simply apply a slight upward or twisting pressure to the cleat (FIG. 7). This movement of the cleat tends to lessen the gripping actions of the cleat against the cord and against the article enough that the loop relaxes slightly and the article slides down out of the loop. Alternatively, the loop that holds the article may be loosened by lessening the tension on the cord and sliding the cleat up on the middle section of the cord to enlarge the loop, so that the article may be removed and the cord left to hang neat and untangled. Alternatively, in cases in which a strap, loop, or handle is captured by the cord and cleat, the end of the loop may be removed from its position over the cleat or jug neck and the loop then removed from the article's strap, loop, or handle.

The hanger is attractive and compact. The hanger is strong, has a thin profile, and does not have protruding or bulky structural members that might interfere with large articles hanging neatly and generally vertically down from the hanger. The cords' length may be changed easily to hold different articles at various distances from the support member, by removing one or more cords from the support member and replacing it/them with other lengths of cords.

DESCRIPTION OF THE PREFERRED EMBODIMENTS

Figure 2:
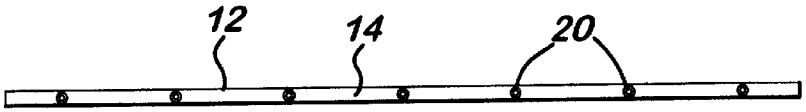
FIG. 2 is a top view of the support bar of the embodiment of FIG. 1, without cords attached.
Figure 3:
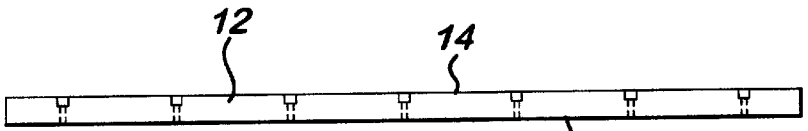
FIG. 3 is a front side view of the support bar of FIG. 2.
Figure 4:
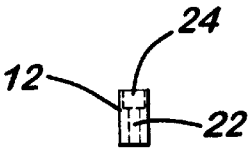
FIG. 4 is an end view of the support bar of FIG. 2.

Referring to the Figures, there is shown one, but not the only, embodiment of the invented hanger system. The hanger 10 includes a support member that has a horizontal component. The preferred support member is a support bar 12 which is elongated in its length and narrow in its width (direction into the paper in FIG. 3) and height (dimension from its top surface 14 to its bottom surface 16 in FIG. 3). The bar 12 may be various lengths, depending on how many cords are to be used, and therefore how many articles are to be hung. Preferably, the bar 12 is about 2 feet long to accommodate about 6–8 cords, spaced about 3–4 inches apart from each other. Preferably, the bar is about 1 inch wide to allow room for approximately ¼–½-inch diameter holes 20 to be drilled or otherwise formed in the bar 12 without compromising the strength of the bar.

The holes 20 extend between the bottom surface 16 and the top surface 14 of the bar 12. Each hole 20 is countersunk at its top to produce a large-diameter portion 24 near the top surface 14 and a small-diameter portion 22 near the bottom surface 16. The holes 20 are preferably evenly-spaced for giving an attractive symmetry, but uneven spacing may also be used. The holes 20 are preferably in a straight line because they are vertically bored through a narrow, straight bar.

From each hole 20 hangs a cord 30. The proximal end 32 of the cord 30 is threaded into the bottom of the hole and through the bar 12. The proximal end is then tied in a knot larger than the small-diameter portion 22 to retain the cord in the hole. The hole is sized so that the cord cannot be pulled down out of the hole by the weight of the article that will hang from it or by the force of the user pulling on the cord when he/she is adjusting the cord or article. Preferably, but not necessary, the knot, cord, and the hole are relatively-sized so that the knot fits down out of sight in the large-diameter portion 24. Alternatively, the knot may protrude at the top of the bar, or some tab or protrusion may extend up out of the hole 20, so that the user may easily access each cord and pull the proximal end up out of the hole to untie it and either remove the cord or replace the cord. In embodiments where the knot rests on top of the bar and is not hidden in the hole, the hole may be made a single diameter, because the top surface of the bar serves to restrain the knot.

Preferably, the bar includes a plurality of holes 23 extending through the bar from front surface to back surface, to allow neat and convenient attachment of the hanger 10 to a wall or other vertical surface, by means of screws, nails, etc. Such a secure attachment allows the user to tug at the hanger and manipulate the hanging articles without moving the bar and disrupting the order of the hanging articles. Alternatively, the support member may be hung from the edge of a piece of furniture. The hanger may also be attached to the undersurface of a horizontal surface, such as a cabinet or ceiling. Such embodiments that are hung from horizontal surfaces would preferably have an alternative method for attaching the cords to the support member, because cord knots would not be reachable at the top of the support bar. For example, the support bar could be turned 90 degrees so that the knots would still be reachable, or the cords could be tied to eyelets depending from the support bar.

Other support members may be used and other ways of attaching the cords to the support member may be used. The support member may even be an irregular shape, if desired, with the cords hanging from attachment points in various areas on the support member. The cords may be fastened to the support member by various means, for example, tying of the proximal end around a nail or an eyelet. Preferably, the cords do not extend 360 degrees around the bar, so that the bar may be attached flat to a wall or other surface. The cords need not all have attachment points that are in a straight line and not necessarily all lying in a horizontal plane. However, preferably, the cords are horizontally spaced from each other at their attachments points, so that no more than one cord hangs in a given vertical plane. This arrangement minimizes tangling and jumbling of the cords and the articles.

Figure 1:
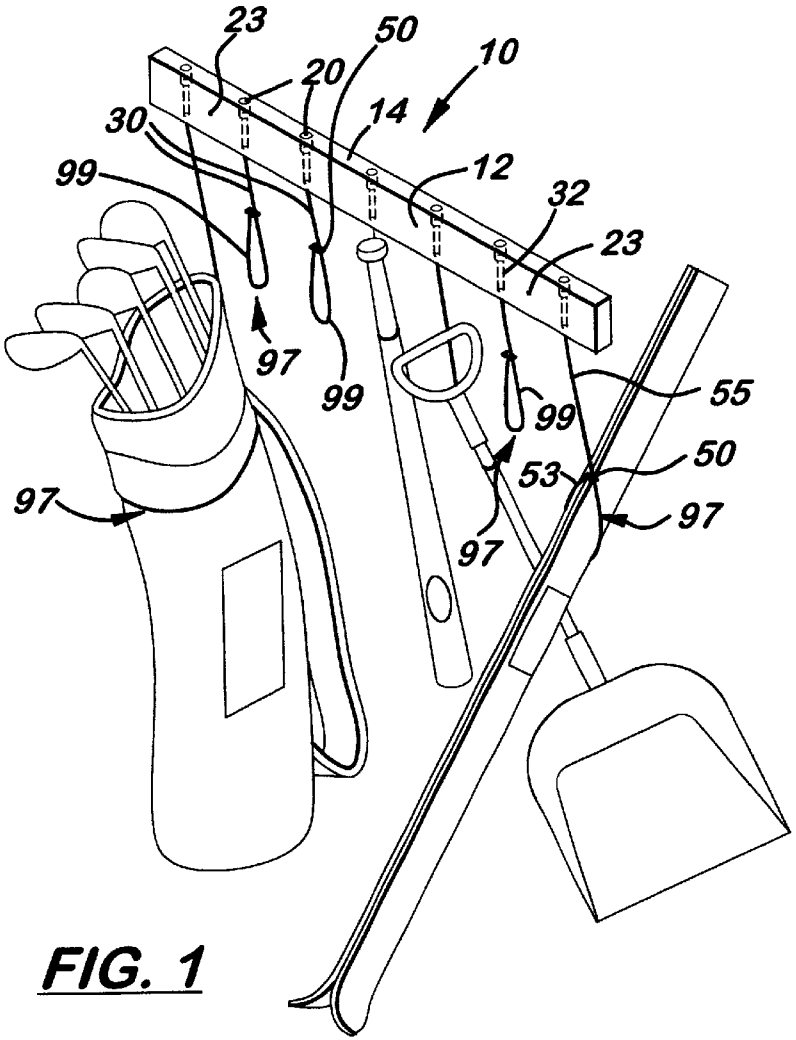
FIG. 1 is a perspective view of one embodiment of the invented hanger, in use with several sport and maintenance articles hanging from it.

The preferred straight, narrow bar of the hanger is a shape that lends itself well to their being a plurality of the hangers hung in a grouping, for example, in a straight, horizontal row along a wall. Or, one hanger may be hung above another on a wall, with the top hanger, for example, having short cords for receiving and securing smaller items, and with the bottom hanger having longer cords for larger, long items. As shown in FIG. 1, the hanger may be supplied with different lengths of cords to accommodate very differently sized items.

The preferred, but not the only, adjustable fastener is herein called a "cleat" 50, in that it has two opposite ends, each of which slidably receives a portion of the cord 30. A first end 52 receives the cord near its distal end 53 and the second end 54 receives the cord near its middle portion 55. Normally, this is achieved by threading the cord in opposite directions through two holes 57 near the cleats ends, and providing a knot 56 or other stop on the distal end of the cord to prevent the cleat 50 from slipping off of the cord.

Figure 7:
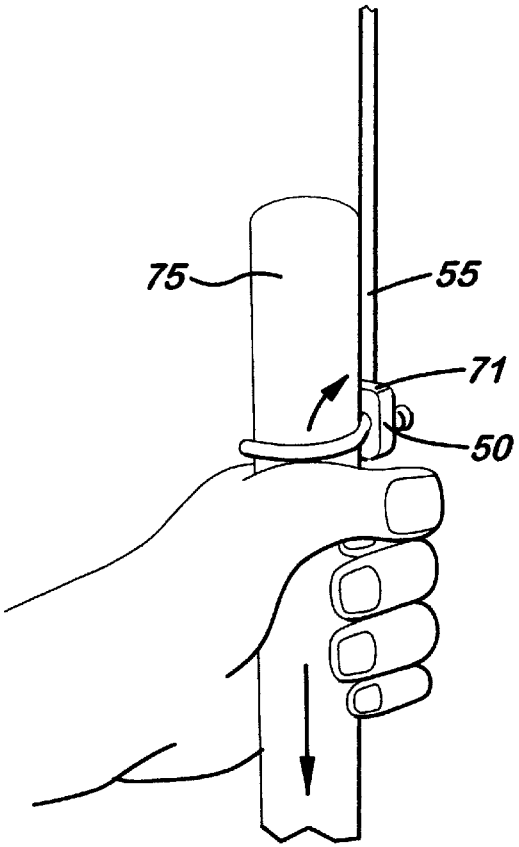
FIG. 7 is a partial view of the hanger and tool of FIG. 6, wherein slight movement of the cleat allows the tool to slide out of the cord loop.
Figure 6:
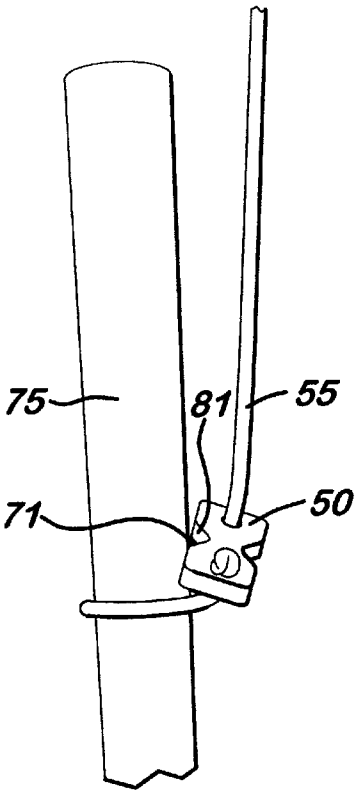
FIG. 6 is a partial perspective view of one embodiment of the hanger holding a tool handle, in part by the cleat exterior edge being forced against the handle.
Figure 5:
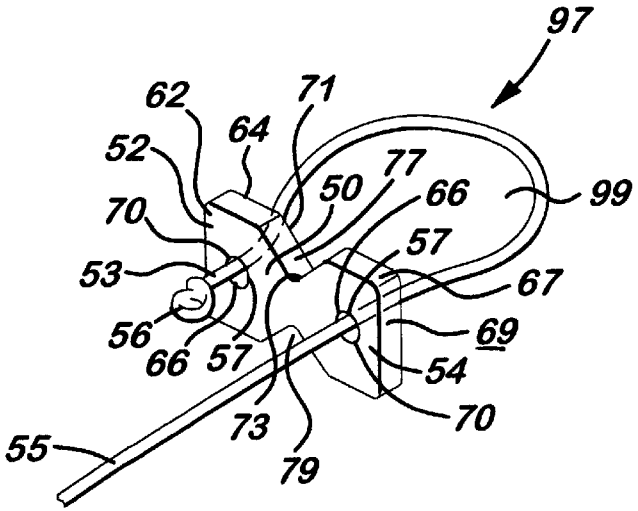
FIG. 5 is a perspective view of one embodiment of a looped cord with a loop fastener, such as is portrayed in FIG. 1.

The preferred cleat 50 further comprises two ends, two opposite surfaces (a first surface 62 and a second surface 64) and an exterior perimeter surface around the cleat. The two opposite surfaces are preferably flat, planar surfaces. The preferred cleat 50 has a thickness dimension between its first surface 62 and second surface 64, which creates the exterior perimeter surface extending around the cleat that can be seen in the drawings as exterior side surfaces 67, 69. The first surface 62 and second surface 64 form generally 90 degree angles with the exterior perimeter surface at exterior perimeter edges 71, 73 and with the hole interior surfaces 66 at edges 70. The 90 degree angles provide these generally sharp edges 70 in the holes for biting/gripping into the cord to anchor the distal end of the cord relative to the middle section to establish and maintain a given size of loop. As may be seen to best advantage in FIGS. 1 and 5, the loop 97 is formed by a portion of the cord distanced from the cleat to create an open space 99 for receiving an object to be hung. Also, the 90 angles of the exterior perimeter edges 71, 73 form sharp corners that bite/grip against/into the article 75. The cleat exterior perimeter surface preferably has a notch 77, 79 on each side for receiving an article 75, as shown in FIG. 6. When the notch receives the article, the cleat is in generally horizontal position (FIG. 6) and the exterior edge 71 of the cleat in/near the notch 77 tends to bite/grip against the article and further assist the system in holding the article in the loop. FIG. 7 illustrates that the user may typically remove an article 75(especially, an elongated tool handle) that is held by this technique, by applying slight upward pressure on the cleat to twist the cleat to a more vertical position. This upward/twisting movement of the cleat tends to release tension on the loop and let the article slide down and out of the loop.

The cleat can be effective in situations in which the edges 71, 73 do not bite into the article but the hole edges 70 bite into the cord. When the cord is pulled against the edges 70 at an angle (preferably less than 45°), the cord is gripped by the cleat, because the cord is, in effect, crimped in one or both holes 57. In such cases, when the user wishes to secure an item, he/she holds the cleat generally perpendicular to the cord and slides it along the cord to enlarge the loop. He/she then inserts the item into the loop, and slides the cleat back closer to the item and finally secures the item by seeing that the middle portion 55 of the cord bends outward from its hole, and, in doing so, is gripped by the corner of the hole. Thus, the cord is held from sliding through the hole until the user purposely moves the cleat again.

Figure 8:
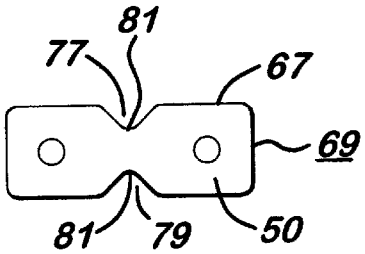
FIG. 8 is a plan view of the cleat of FIGS. 6 and 7.

The preferred cleat has a somewhat figure-8 shape with notches 77, 79 midway along the cleat. The notches each preferably form about 80–100° corners 81 and are cut from acrylic to have effective exterior and hole corner edges and to be attractive.

Figure 9:
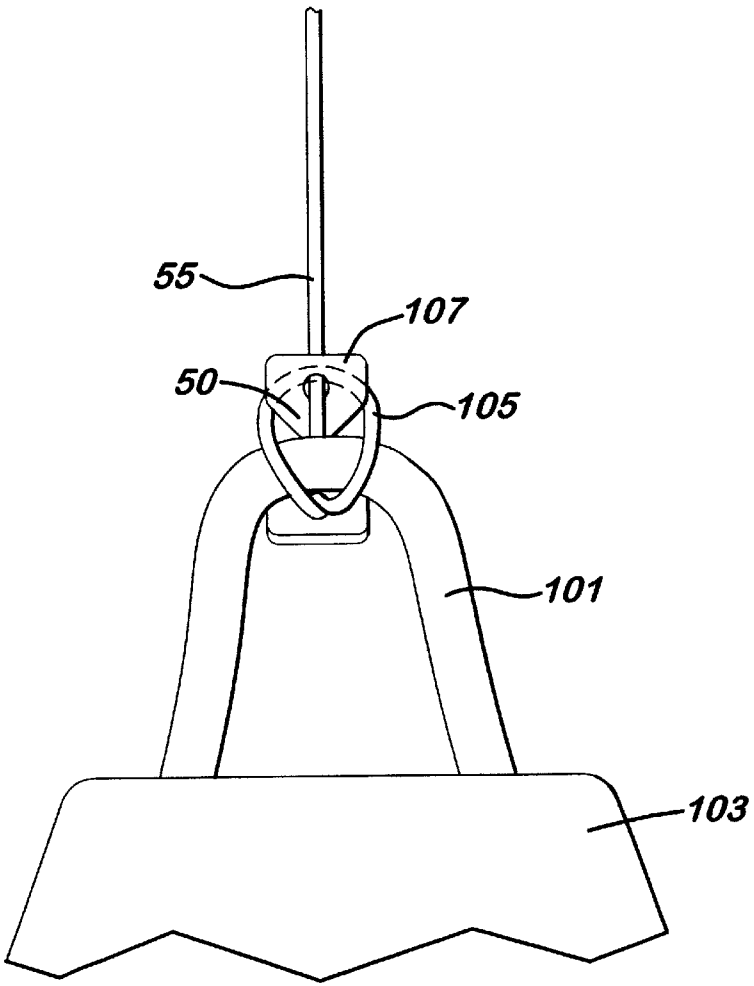
FIG. 9 is a side view of an alternative method of using the invented hanger of and alternative method of using the invented hanger of FIGS. 6 and 7 to hold an article with a strap.

Other slidable fasteners may be used, but the invented cleat allows many effective hanging techniques. In addition to the technique shown in FIGS. 6 and 7, the cleat and cord system may be used, for example, as in FIG. 9, to hold a strap 101 of an article 103. With the cleat generally vertical, the loop 105 is drawn through the strap and then brought up and over the top end 107 of the cleat, between the cleat and the cord middle portion 55. The strap 101 is thus captured until the loop 105 is pulled up and off the cleat 107. An alternative technique is to draw the loop 105 through the side handle of a jug or bottle and then place the loop around the jug/bottle neck.

Figure 10:
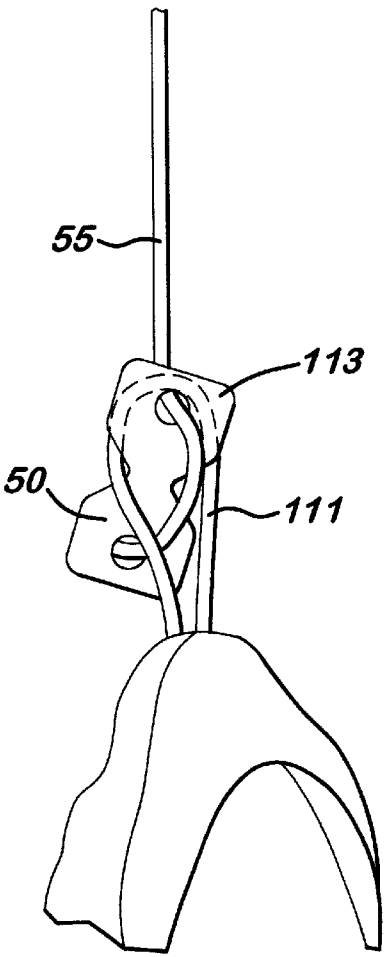
FIG. 10 is a side view of another method of using the hanger of FIGS. 6 and 7 to hold a garment loop.

FIG. 10 shows yet another method of using the cleat and cord system. The cleat 50 is held generally vertical with the knot-end down and a coat loop, or other loop 111, is placed over the top end 113 of the cleat. In this way, the cleat system acts generally as a hook to hold the coat.

The preferred bar is wooden, but other materials may be used. Plastic or metal may also be used, as well as paint and/or other indicia such as names, designs, or labels.

Although this invention has been described above with reference to particular means, materials and embodiments, it is to be understood that the invention is not limited to these disclosed particulars, but extends instead to all equivalents within the scope of the following claims.

I claim:

1. A hanger system comprising a hanger and a suspended object hanging from the hanger, the hanger comprising:

a support member;

a cord having a proximal end and a distal end, said cord being secured to said support member at said proximal end of said cord; and a generally planar cleat secured to said cord at the distal end of the cord, said cleat having an aperture therethrough for slidably receiving said cord;

the cord further extending through said aperture and forming an adjustable open loop with an interior space;

wherein said suspended object is received inside the interior space of the adjustable open loop, and wherein the adjustable open loop is tightened around said suspended object;

said cleat also having a notch in a side surface receiving said suspended object, the notch being defined by walls having an exterior perimeter edge frictionally gripping the suspended object received in said loop;

wherein said suspended object is suspended by the hanger by a combination of the adjustable open loop surrounding the suspended object and said exterior perimeter edge frictionally gripping the suspended object.

2. A hanger system as in claim 1, wherein the notch is a V-shaped notch defined by walls meeting each other at a 80–100 degree corner.

3. A hanger system as in claim 2, further comprising two V-shaped notches in opposing side surfaces of the cleat, and wherein one of said V-shaped notches receives and frictionally grips the suspended object received in said loop.

4. A hanger system as in claim 3, wherein the two V-shaped notches are each defined by walls meeting each other at 80–100 degree corners.

5. A hanger system comprising a hanger and a suspended object hung from the hanger, the hanger comprising:

an elongated support member having a longitudinal axis, and a top surface and a bottom surface perpendicular to the longitudinal axis;

a cord hanging from the support member, the cord having a proximal end connected to the support member, a middle region, and a distal end;

a cleat on the distal end of said cord, the cleat comprising:

a plate with a central region, a first end region and a second end region, and a length between the first end region and second end region;

generally parallel and opposing first and second planar surfaces and a thickness between the first and second planar surfaces;

two exterior perimeter side surfaces perpendicular to the first and second planar surfaces, and a width between said side surfaces normal to the length and normal to the thickness;

each of the two sides surfaces having a 80–100 degree V-shaped notch near the central region of the cleat between the first and second end regions and having an exterior perimeter edge in the V-shaped notch; and the second end region having a hole through the cleat from the first surface to the second surface and hole interior surface surrounding and defining the hole; and the hanger further comprising:

the cord distal end secured to the first end region of the cleat, the cord middle region slidably passing through the hole in the second end region of the cleat, and the cord between the distal end and the middle region of the cord forming an open loop distanced from the cleat and having an interior space; and the cleat having 90 degree angles between said first planar surface, said second planar surface, and said hole interior surface, said angles providing sharp corners to bite into the cord to anchor the distal end of the cord relative to the middle portion of the cord, thereby establishing and maintaining said loop;

wherein said suspended object is received inside the interior space of the open loop, the open loop is tightened around said suspended object, the V-shaped notch receives said suspended object and the exterior perimeter edge frictionally grips said suspended object.

6. The hanger system as in claim 5, wherein the first end region has a hole through the cleat from the first surface to the second surface and a hole interior surface surrounding and defining the hole, and wherein said cord distal end passes through the first end region hole and is knotted near the second planar surface to secure the cord distal end in the first end region hole.

7. The hanger system as in claim 5, the support member including a plurality of holes extending from the top surface to the bottom surface, and the hanger system further comprising a plurality of cords with knotted proximal ends secured in the support member holes, and one of said cleats on distal ends of each of said cords.

8. The hanger system as in claim 5, wherein the cleat is a generally figure-8-shaped plate with a circular hole in each of the first and second end regions.

* * * * *